United States Patent [19]

Brochman et al.

[11] 4,445,620

[45] May 1, 1984

[54] TAMPER-PROOF CLOSURE FOR CONTAINER

[75] Inventors: Wilfred R. Brochman, Oakdale; Richard A. Patterson, Woodbury, both of Minn.

[73] Assignee: Minnesota Mining and Manufacturing Company, St. Paul, Minn.

[21] Appl. No.: 380,517

[22] Filed: May 21, 1982

[51] Int. Cl.[3] ..... B65D 17/34

[52] U.S. Cl. ..... 220/271; 220/260

[58] Field of Search ..... 220/260, 270, 271, 359

[56] References Cited

U.S. PATENT DOCUMENTS 4,163,506 8/1979 Patterson ..... 220/260

4,164,303 8/1979 Waterbury ..... 220/359

*Primary Examiner*—George T. Hall

*Attorney, Agent, or Firm*—Donald M. Sell; James A. Smith; John C. Barnes

[57] ABSTRACT

A tape closure comprising a two-tape closure system for a pour opening in a container wherein the pull tab for the closure is secured to the container end by a rupturable nonresealable holddown.

4 Claims, 5 Drawing Figures

TAMPER-PROOF CLOSURE FOR CONTAINER

DESCRIPTION

1. Technical Field

This invention relates to an improvement in easy-openable tape closure systems for containers, and in one aspect, to a tamper-proof closure to permit visible inspection of the seal.

2. Background Art

Easy-open tape closure for containers are known utilizing a two-tape closure system for a pour hole in the container end including the combination of an interior sheet material covering the pour hole on the inner side of the container end, an exterior tape covering the pour opening on the exterior surface of the container end, and a pull tab extending over the exterior tape to peel the tape and open the pour opening. An improved structure is disclosed in U.S. Pat. No. 4,405,056, issued Sept. 20, 1983 and assigned to the common assignee, including a vent opening in the exterior tape in the area of the pour opening which is opened by the pull tab which is bonded to the interior tape through the vent opening. The prior tape closure systems did not provide a non-resealable tab affording an indication of any tampering with the vent seal which could be readily detectable by the observer. Thus, it is the purpose of this invention to provide a tape closure for a container end which incorporates a seal for the pull tab of the closure such that one can readily inspect the closure to determine whether or not the closure has been ruptured or opened.

DISCLOSURE OF INVENTION

The present invention provides an easy-open closure for containers having a panel with a preformed pour opening. The easy-open tape closure system comprises an interior sheet material which covers the interior surface of the container end and which is firmly adhered to the end circumjacent the pour opening, an exterior flexible tape adhered to the end portion of the container on the exterior surface about the pour opening and firmly adhered to the interior tape in the area of the pour opening and being folded back upon itself on each end of the pour opening for forming a grip or pull tab and hold-down means therefor. The grip tab extends from one marginal edge of the pour opening across the exterior tape and is secured by a rupturable hold-down means at the opposite end of the pour opening. An example of the rupturable hold-down means is an upturned end of the exterior tape to which the grip tab end is bonded. The end of the exterior tape is weakened as by scoring or perforations along the fold line to rupture upon lifting force being applied to the grip tab to lift the same from the exterior tape.

BRIEF DESCRIPTION OF THE DRAWINGS

This invention will be described in greater detail hereinafter with reference to the accompanying drawings wherein.

BEST MODE FOR CARRYING OUT THE INVENTION

Figure 1:
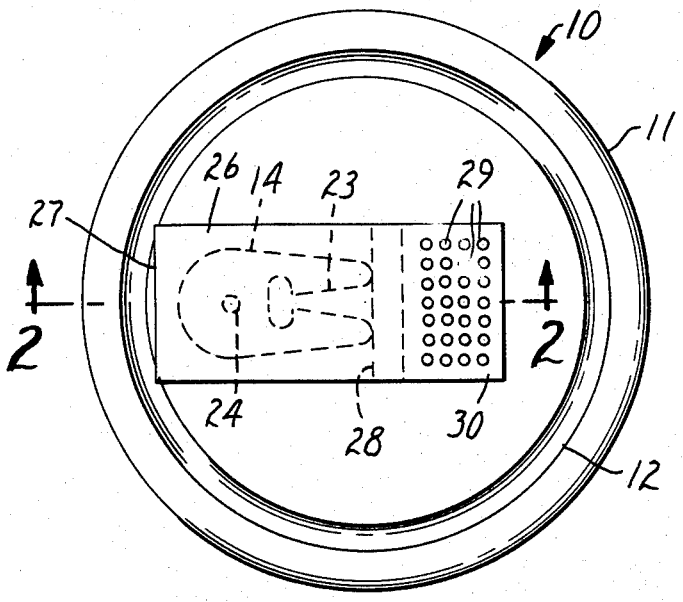
FIG. 1 is a plan view of a container end assembly constructed in accordance with the present invention.
Figure 2:
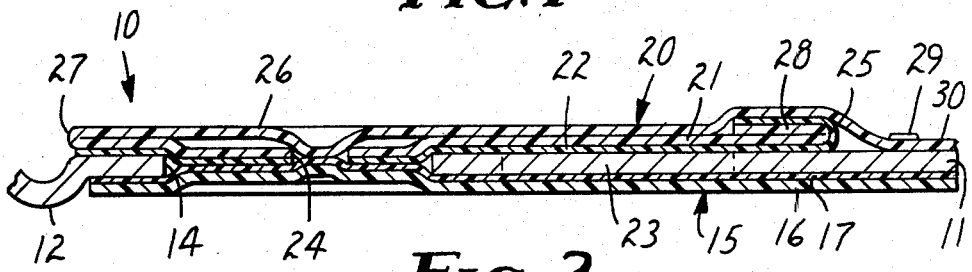
FIG. 2 is an enlarged sectional view taken along the line 2—2 of FIG. 1.

The container end assembly 10 of the present invention is illustrated as a can end 11 formed of flexible metallic sheet material by a stamping operation, and comprises a generally circular, flat disc of material formed with a circular chime 12 and a preformed U-shaped pour opening 14. The closure for the assembly comprises an interior sheet material 15 which comprises a backing member 16 which is firmly adhered to the underside or interior surface of the can end 11 by means of an adhesive layer 17. The interior sheet material 15 is adhered about the pour opening 14. In the area of the pour opening the interior sheet material is adhesively secured to an exterior tape material 20. The exterior tape material 20 comprises a flexible backing to which is coated an adhesive layer. The exterior tape material has one portion 21 adhesively secured by the adhesive layer 22 to the exterior surface of the can end 11 around the pour opening 14 and to a tongue-like member 23 which projects into the pour opening from one end thereof. In the area of the pour opening the portion 21 of the exterior tape 20 is firmly adhered to the interior tape 15. Portion 21 of the exterior tape is also formed with a vent opening 24 in the area of a pour opening exposing the adhesive 17 of the interior tape 15 at the vent opening.

The exterior tape is folded at one end of the pour opening adjacent the tongue along a weakened line formed by scoring or by perforations 25 in the tape. The folded tape defines rupturable hold-down means for the free end of a grip tab. The hold-down means comprises a short band 28 exposing a band of the adhesive 22. The portion 21 is joined to the pull tab portion 26 of the exterior tape at a fold line 27. The pull tab portion formed onto the exterior tape portion 21 near the fold line 27 extends back across the tape portion 21. This pull tab portion 26 covers the vent opening 24 and is sealed to the interior tape 15 through the vent hole 24 and it extends on over the exterior tape portion 21 and over the band 28 where again the pull tab portion 26 is securely and firmly sealed to the band 28 by the exposed adhesive 22. The end 30 of the pull tab 26 is positioned beyond the band 28 a short distance and is formed with surface irregularities such as embossments 29 to permit the consumer to grasp the end of the grip tab portion 26 and open the closure assembly.

Alternatively, the rupturable hold-down for the grip tab may be a spot or strip of low strength rupturable thermoplastic adhesive placed between the grip tab and the exterior tab.

Sealing the pull tab portion 26 at the vent opening 24 and onto the band 28 of the external sealing tape portion 21 makes the pull tab lie flat against the container end and its seal to the band 28 forms a tamper-proof seal for the closure. In the event that the pull tab is tampered with or lifted sufficient such that the vent opening, for example, could be opened the band 28 will be torn free from the sealing tape 21 because of the perforations 25 along the fold line of the tape, and the pull tab will not be resealable as the band 28 will not be sealed or sealable back down to the exterior tape portion 21.

Figure 3:
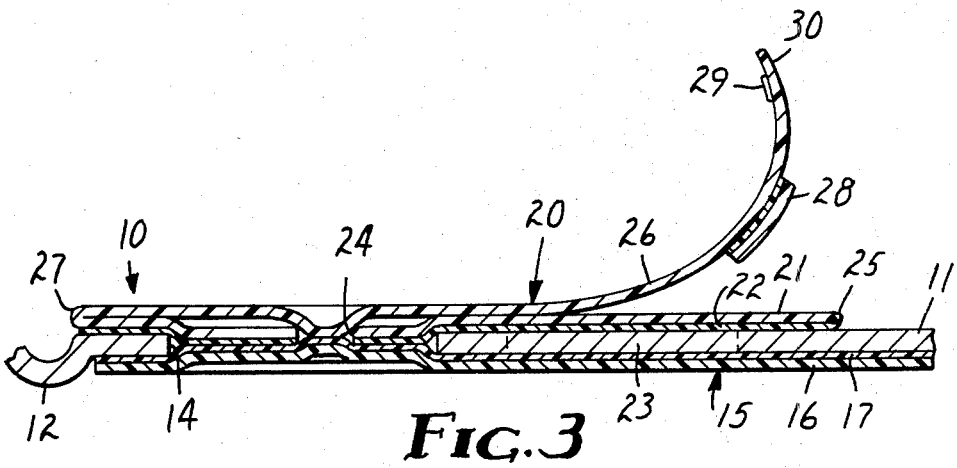
FIG. 3 is a sectional view according to FIG. 2, showing the pull tab being lifted from the container end panel and the rupture of the seal for the grip tab.
Figure 4:
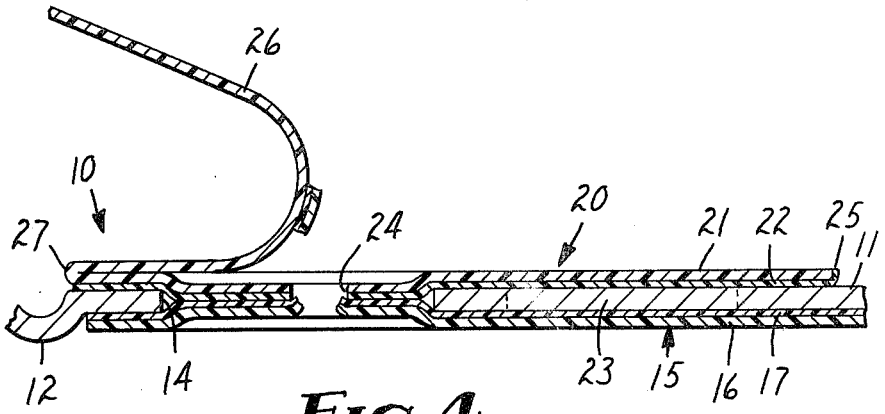
FIG. 4 is an enlarged cross-sectional view showing the next step of the opening of the container showing the venting of the container.
Figure 5:
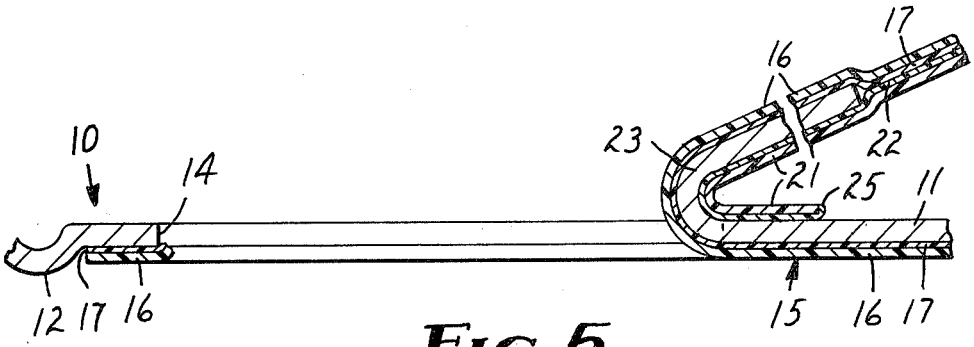
FIG. 5 is a detailed cross-sectional view showing the pour hole opened with the closure tapes folded back over the container panel.

The closure system illustrated is opened by the consumer gripping the end 30 of the pull tab portion 26 and lifting it from the can end 11 with sufficient force to rupture the tape between the perforations 25 joining the band 28 to the exterior tape portion 21 as illustrated in FIG. 3. The continued lifting of the pull tab 26 then vents the container by separating the pull tab portion 26 from the vent opening tearing the interior tape 15 at the vent opening 24 where the pull tab 26 is tightly bonded to the interior tape 15 by the adhesive 17. This is illustrated in FIG. 4. The venting of the can is essential when the container contains a gas-containing beverage and pressure can build up within the container.

Continued pulling of the pull tab then begins to unfold the exterior tape at fold line 27, and a peeling of the exterior tape portion 21 and the adhesive 22 from the external surface of the can. As the peeling reaches the edge of the pour opening 14 the interior tape material in the area of the opening 14 remains adhered to the exterior tape portion 21 and tears cleanly out of the opening 14 to provide access to the contents of the container. The continued lifting of the pull tab 26 and the peeling of the exterior tape portion 21 causes the tongue-like portion 23 to lift along with the tapes between which it is sandwiched. The presence of the tongue provides means for securing the interior and exterior tapes to the container to discourage or prevent complete removal of the tapes when opening the container, and the tongue-like portion 23 will take a permanent set and hold the tape clear of the pour opening 14 such that it will not be in the way or objectionable when pouring or drinking the contents of the container through the pour opening. The use of this tongue-like member is disclosed in U.S. Pat. No. 4,108,330, assigned to the assignee of this application.

Constructions for the interior and exterior tape sheet material and backing together with the adhesive useable therewith, are disclosed in copending application Ser. No. 264,657, filed May 18, 1981, in the name of W. R. Brochman, and assigned to the assignee of this application, now U.S. Pat. No. 4,378,074, the disclosure of which is specifically incorporated herein by reference.

We claim:

1. A container end assembly comprising:

a container end having a preformed pour opening, an interior and exterior surface, and an easy-opening closure system covering said pour opening comprising:

an interior tape having an adhesive on one surface adhered to the interior surface of the container end and covering said pour opening, an exterior tape covering said pour opening and adhered to said interior tape in the area of said pour opening and being adhered to the exterior surface circumjacent said pour opening, a pull tab secured to said exterior tape at one end thereof which extends over said exterior tape, and rupturable means for holding said pull tab to the exterior tape to define a tamper-proof seal for the pull tab.

2. A container end assembly according to claim 1 wherein said exterior tape has a vent hole formed therein in the area of the pour opening and said pull tab is bonded to the interior tape through said vent hole intermediate said one end and said rupturable means.

3. A container end assembly comprising:

a container end having a preformed pour opening, an interior and exterior surface, and an easy-opening closure system covering said pour opening comprising:

an interior tape having an adhesive on one surface adhered to the interior surface of the container end and covering said pour opening, an exterior tape covering said pour opening and adhered to said interior tape in the area of said pour opening and being adhered to the exterior surface circumjacent said pour opening, a pull tab secured to said exterior tape at one end thereof which extends over said exterior tape, and rupturable means for holding said pull tab to the exterior tape to define a tamper-proof seal for the pull tab, said rupturable means comprising a folded end of said exterior tape forming a narrow band which is firmly bonded to said pull tab and wherein said band is joined to said exterior tape by a weakened fold line.

4. A container end assembly comprising:

a container end having a preformed pour opening, an interior and exterior surface, and an easy-opening closure system covering said pour opening comprising:

an interior tape having an adhesive on one surface adhered to the interior surface of the container end and covering said pour opening, an exterior tape covering said pour opening and adhered to said interior tape in the area of said pour opening and being adhered to the exterior surface circumjacent said pour opening, a pull tab secured to said exterior tape at one end thereof which extends over said exterior tape, and rupturable means for holding said pull tab to the exterior tape to define a tamper-proof seal for the pull tab, said rupturable means comprising a length of said exterior tape opposite said one end which is bonded to said pull tab and which is joined to said exterior tape along a weakened line.

* * * * *